United States Patent [19]

Sult

[11] 4,130,996

[45] Dec. 26, 1978

[54] REFRIGERATION SYSTEM AND EVAPORATOR UNIT THEREFOR

[76] Inventor: Gratz M. Sult, Box 164, Poplar St., Intercourse, Pa. 17534

[21] Appl. No.: 803,430

[22] Filed: Jun. 6, 1977

[51] Int. Cl.[2] ..... F25B 39/04; F25B 41/00

[52] U.S. Cl. ..... 62/113; 62/184; 62/238

[58] Field of Search ..... 62/113, 183, 238, 305, 62/513, 184

[56] References Cited

U.S. PATENT DOCUMENTS

| | | | |
|---|---|---|---|
| 1,937,984 | 12/1933 | Scherer et al. | 62/113 |
| 2,693,682 | 11/1954 | Winger et al. | 62/115 |
| 3,812,687 | 5/1974 | Stolz | 62/305 |
| 4,041,726 | 8/1977 | Mueller et al. | 62/238 |

*Primary Examiner*—Louis J. Casaregola

*Attorney, Agent, or Firm*—Michael R. Swartz; John R. Flanagan

[57] ABSTRACT

In a bulk-milk cooling refrigeration system having an evaporator unit disposed within a bulk-milk cooling reservoir and interconnected with a water-cooled condenser unit for cooling milk in the reservoir, the hot water generated from the condenser unit during operation of the system is circulated through the evaporator unit to reduce its temperature whereby the water may be re-used in the water-cooled condenser unit, thereby conserving water and eliminating costly water storage tanks.

8 Claims, 4 Drawing Figures

REFRIGERATION SYSTEM AND EVAPORATOR UNIT THEREFOR

BACKGROUND OF THE INVENTION

1. Field of the Invention

The present invention relates to refrigeration systems, and, more particularly, is concerned with an improvement of a refrigeration system which utilizes a water-cooled condenser unit.

2. Description of the Prior Art

One commercial refrigeration system in use on dairy farms for bulk cooling of milk produced after each milking of the dairy herd incorporates a water-cooled condenser unit. Well water at approximately 60° F. is pumped to the condenser unit from the bulk milk cooling tank, is transferred to the water such that the water flowing from the condenser unit is at approximately 145° F. As a rule of thumb, the water-cooled condenser unit of this commercial refrigeration system when operating with 60° F. well water will produce a volume of 145° F. water generally equal to the volume of milk being cooled after a milking. For example, if 100 gallons of milk per milking is to be cooled by the system, approximately 100 gallons of 60° F. well water will be required by the water-cooled condenser unit for operation of the refrigeration system and 100 gallons of 145° F. water will be produced thereby.

The hot water produced by this system is generally pumped into one or more storage tanks from which some of it is utilized for "prepping" the dairy cows and washing the milk cooling tank, the milking equipment and the milking parlor itself. However, a substantial volume of the hot water is commonly drained off as waste after each milking since 60° F. water is required to operate the refrigeration system.

Some dairy operators store the surplus hot water for later re-use in the refrigeration system once its temperature decreases to where it can be mixed with cold well water, thus conserving to a limited degree the overall amount of fresh cold well water that will be required. But such practice necessitates the utilization of more space for and added expense of installation and maintenance of several more water storage tanks.

SUMMARY OF THE INVENTION

The improvement provided by the present invention fosters new economics in the above-mentioned commercial refrigeration system by providing an overall reduction and savings in space and equipment requirements and conservation of water resources. In contrast to the prior art refrigeration systems wherein, after an initial period of operation, water is wasted, the improved refrigeration system conserves water without the need for additional costly storage tanks.

In accordance with the principles of the present invention, there is provided in an improved refrigeration system having a bulk-milk cooler reservoir, an evaporator unit disposed within the reservoir and a water-cooled condenser unit operably interconnected with the evaporator unit for cooling milk within the reservoir, means for cooling hot water generated by the water-cooled condenser unit during operation of the refrigeration system for re-use of the water by recycling the same through the condenser unit thereby conserving water usage and preventing waste.

More particularly, the hot water cooling means includes water coolant coils disposed in heat transfer relationship with evaporator coils of the evaporator unit such that the evaporator coils absorb the heat of the milk within the reservoir as well as the heat of the hot water to thereby cool the water sufficiently for re-use in the refrigeration system.

The present invention further encompasses an improved evaporator unit for use in the improved refrigeration system. The improved evaporator unit is of a sandwich construction having upper and lower spaced apart plates and interconnected therebetween is a convolute shaped or corrugated inner member that defines at least two separate passageways through said evaporator unit for carrying fluids separate from one another, such as, water and freon in a heat transfer relationship.

The advantages and attainments of the improvement provided by the present invention will become apparent to those skilled in the art upon a reading of the following detailed description when taken in conjunction with the drawings in which there is shown and described the prior art system and an illustrative embodiment of the improvement thereto provided by the present invention.

BRIEF DESCRIPTION OF THE DRAWINGS

In the course of the following detailed description, reference will be frequently made to the attached drawings in which.

DETAILED DESCRIPTION

THE PRIOR ART REFRIGERATION SYSTEM

Figure 1:
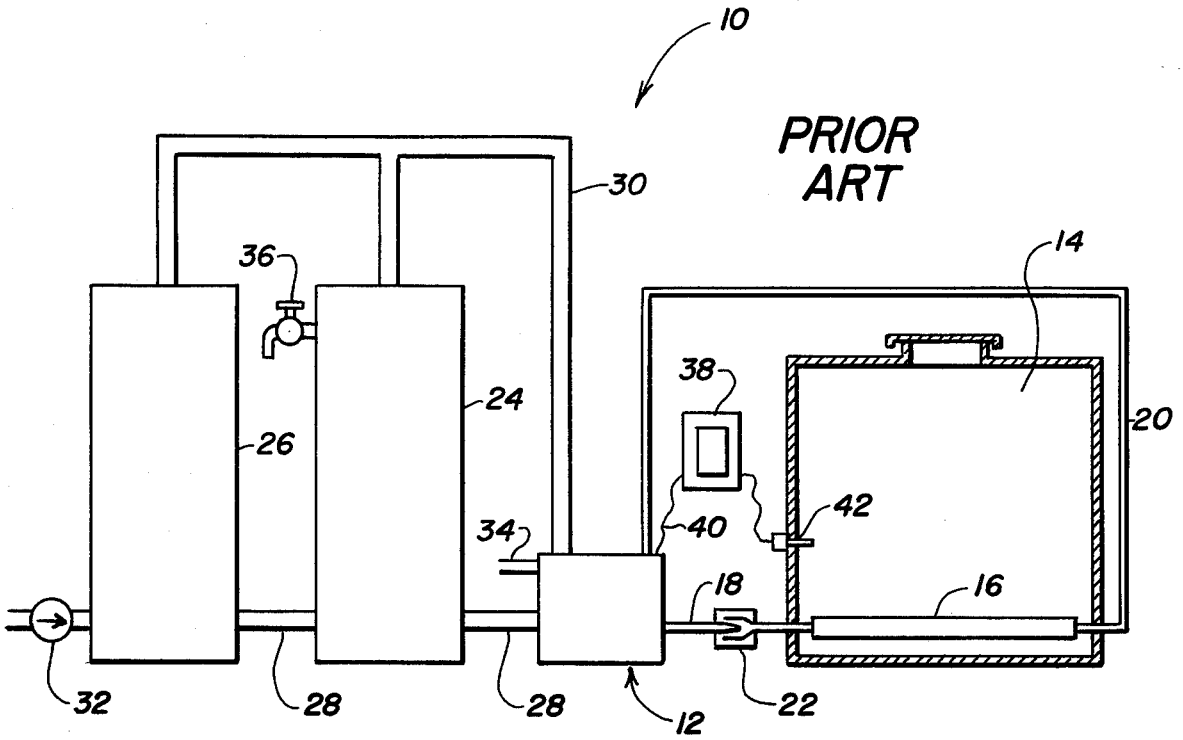
FIG. 1 is a diagrammatic view of a prior art refrigeration system utilized, for example, in bulk cooling of milk.

In FIG. 1, the prior art refrigeration system, briefly mentioned hereinabove, is diagrammatically illustrated, being generally designated by the numeral 10. The prior art system 10 basically includes a water-cooled condenser (heat exchanger) unit 12, a bulk milk cooler tank or reservoir 14, an evaporator plate 16 disposed within the tank 14 in contact with the milk therein, a tube 18 interconnecting the discharge outlet of the condenser unit 12 with the inlet of the evaporator plate 16 for carrying a refrigerant, such as freon, in its liquid state from the unit 12 to the plate 16, and a tube 20 interconnecting the outlet of the evaporator plate 16 with the inlet of the condenser unit 12 for returning the refrigerant in its gaseous or vapor state from the plate 16 to the unit 12. To control the rate of flow of the refrigerant into the evaporator plate 16, an expansion valve (not shown) may be incorporated in the condenser unit 12, or, alternatively, a jet injector device 22 may be interposed within the refrigerant tube 18.

The water-cooled condenser unit 12 is conventional and may be the Fre-Heater TM condenser/heat exchanger unit commercially available from Paul Mueller Company of Springfield, Missouri. Although the condenser unit 12, in FIG. 1, is represented by a block diagram, it is commonly understood to those skilled in the art that such unit contains a compressor for circulating the refrigerant and a condenser coil(s) for condensing the refrigerant from its vapor to its liquid state. Normally, the condenser coil is disposed within a separate water tight compartment within the unit 12 to prevent water damage to the other components of the condenser unit. Generally, well water which is approximately 60° F. is used to cool the freon in the condenser coils. Well water is either pumped directly into the condenser unit 12 or is associated with storage tanks as illustrated in the prior art embodiment.

As seen in FIG. 1, one or more storage tanks 24,26 may be provided in association with the refrigeration system, 10, being interconnected thereto by conventional piping; such as cold and hot water pipes 28,30 respectively as seen in FIG. 1. Well water is delivered to the system from a suitable source, such as a well, through a one-way control valve 32 by a pump (not shown). Interposed within the hot water pipe 30 is a temperature responsive solenoid valve (not shown) which also has connected thereto a drain pipe 34 for draining excess hot water generated by the system. The function of the valve is to allow the hot water to flow through the hot water pipe 30 to replenish the tanks 24,26 or if the temperature of the water exceeds a predetermined value, the valve actuates to change the flow through the drain pipe 34. Additionally provided is a spigot 36 on tank 24 for access to the hot water stored therein.

Electrical power for operating the refrigeration system 10 is supplied to a control box 38. The condenser unit 12 and solenoid valve associated therewith is electrically connected to the control box 38 by lead line 40 and rendered operational by manipulating an on/off switch (not shown) within the box 38. The switch of box 38 is electrically coupled to a thermostat 42 disposed within reservoir 14 in contact with the milk and will automatically shut off the condenser unit 12 when the thermostat senses that the temperature of the milk contained within the reservoir 14 has decreased to approximately 38° F.

Briefly, the operation of the above-described prior art system is as follows. Initially, the water storage tanks 24,26 are filled with cold water and the switch of the control box 38 is turned to the "on" position for automatic control of the condenser unit 12. The thermostat 42 senses the warm milk in the reservoir 14 and actuates the condenser unit 12 wherein the compressor circulates the freon through the closed circuit. Specifically, the refrigerant in a liquid state flows through the metering jet 22 to the evaporator plate 16 wherein the refrigerant absorbs the heat of the warm milk temporarily within reservoir 14 thereby converting the same to a vapor or gaseous state. The refrigerant vapor, carrying off the heat of the warm milk, then passes through the tube 20 to the compressor and condensation coils of the condenser unit 12. The well-water circulates around the condenser coils, extracting the heat from the refrigerant whereby the refrigerant is returned to its liquid state for recycling through the system. As readily understood, the condenser unit 12 generates hot water which is transferred through the solenoid valve and hot water pipe 30 to the storage tanks 24,26. As the tanks receive the hot water, a temperature gradient develops within the water in the tanks, the colder water being at the lower portions of the tanks and the hotter water at the upper portions. As the operation of the system proceeds, the temperature of the water in the lower portions of the tanks begins to rise due to the hot water progressively moving lower and lower within the tanks. The water in the lower tank portions must be maintained at about 60° F. for proper operation of the refrigeration system 10, and therefore, at a predetermined value the solenoid valve opens, routing the hot water to flow out drain pipe 34 at which time more cold water is introduced from the well into the system. Thus, during the operation of the prior art refrigeration system 10, some of the generated hot water is returned to the storage tanks 24,26 and some is drained out and wasted. The latter excess hot water could also be stored for subsequent use; however, this requires still additional storage tanks.

After the day's milking operation is completed, the stored hot water is used for washing the equipment and other similar uses. However, since the bulk of milk produced by the day's milking has been cooled in the reservoir by the refrigeration system 10 and the cooled milk subsequently emptied from the reservoir into a tank truck for transport from the farm, the hot water remaining in the storage tanks 24,26 must be drained off to some other storage area or wasted in order that the tanks 24,26 may again be filled with cold water in preparation for the next milking.

It can be thus understood from the above described operation of the prior art system that a considerable amount of hot water is generated. Although a certain amount of this hot water is used to wash equipment, the majority of it is wasted or requires additional costly tanks to store the same for subsequent use.

THE IMPROVED REFRIGERATION SYSTEM OF THE PRESENT INVENTION

Milking operations in most states are controlled by strict regulations. Among these various requirements is control of the cooling of milk stored in bulk tanks on the farm subsequent to milking and prior to shipment to the milk plant. A typical example of one of such requirements is that bulk milk shall be cooled to 38°–40° F. within two hours after milking. Further, the cooled milk shall not be allowed to rise above a temperature of 50° F. by subsequent addition of warm milk to the bulk tank, and shall be delivered to the milk plant within 66 hours of the initial milking. In order to meet these stringent state requirements in the cooling of milk, the majority of the commercially available refrigeration systems, such as those that utilize the above referenced Fre-Heater TM unit, have built-in excess cooling capacity. However, the prior art refrigeration systems for cooling milk do not utilize this extra cooling capacity. Thus, through improvements provided by the present invention, a more efficient utilization of the commercially available refrigeration systems is achieved which results in a dramatic savings in water resources and in the cost of equipment.

Figure 2:
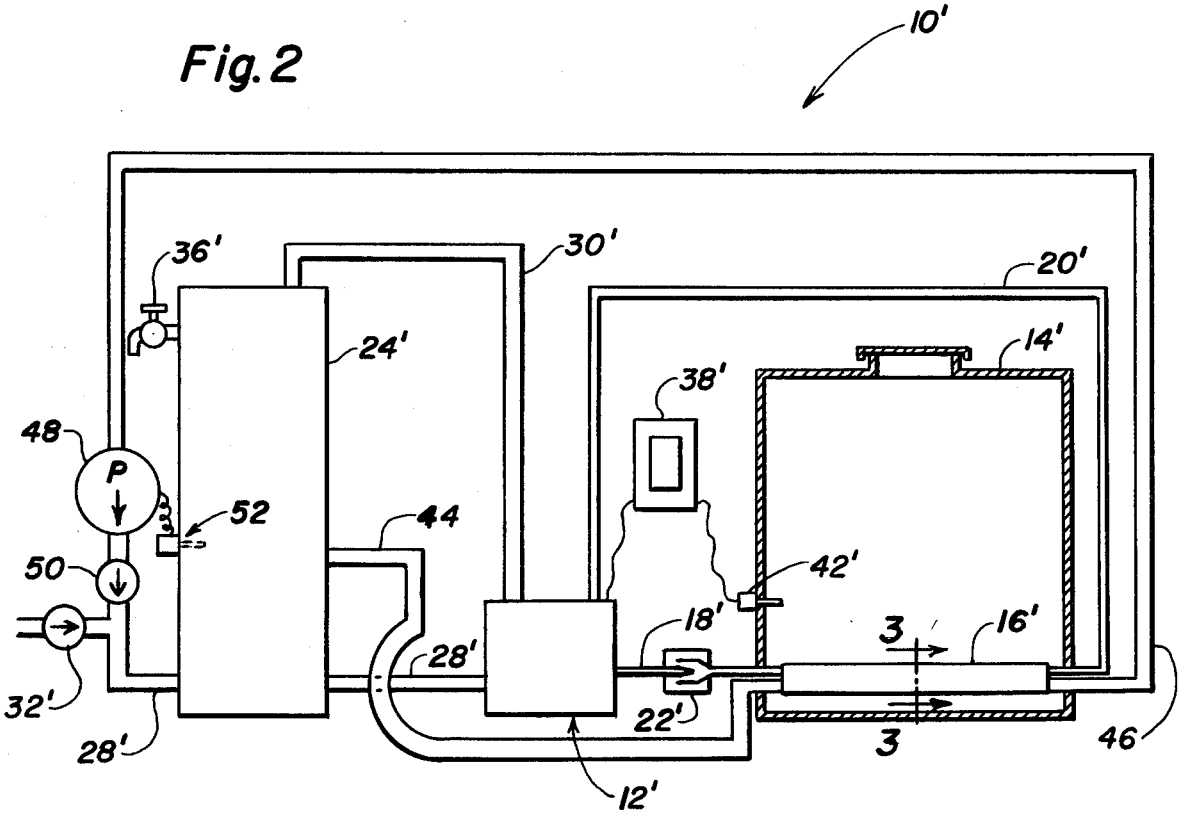
FIG. 2 is a diagrammatic view of the improved refrigeration system embodying the principles of the present invention.
Figure 3:
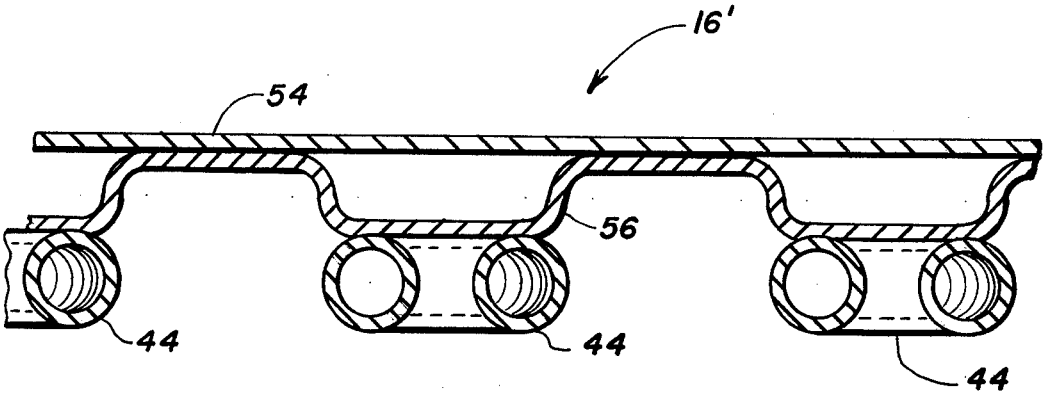
FIG. 3 is an enlarged fragmentary sectional view of a preferred embodiment of the improved evaporator plate utilized in the system of FIG. 2.
Figure 4:
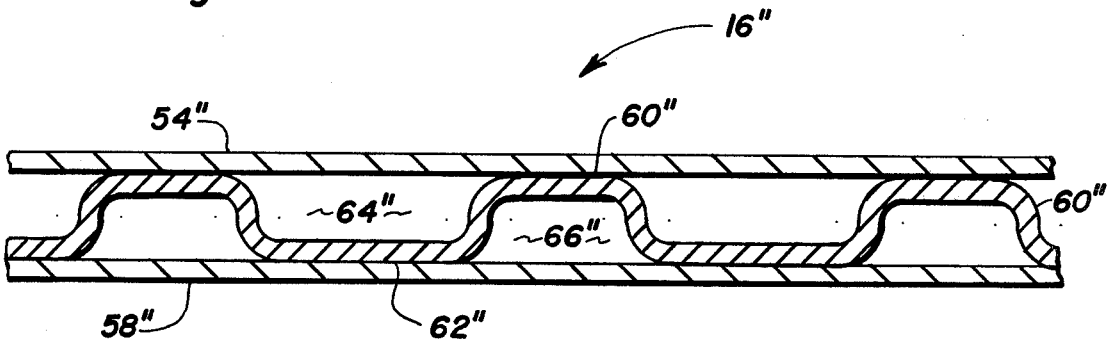
FIG. 4 is an alternative embodiment to that of FIG. 3, showing a stainless steel plate instead of the endless coiled tubes of FIG. 3.

As will be readily appreciated from the following detailed description of the improved refrigeration system, as seen in FIGS. 2, 3 and 4, various components are identical to those of the above described prior art system, thereby requiring only a small modification of an existing system to incorporate the several advantages provided by the improvements of the present invention.

The improved refrigeration system 10', as diagrammatically illustrated in FIG. 2, includes a water-cooled condenser unit 12'; a bulk milk tank or reservoir 14'; an evaporator plate 16'; refrigerant tubes 18', 20'; metering jet 22'; water storage tank 24' and spigot 36'; hot and cold water pipes 28', 30'; valve 32'; thermostat 42'; and electrical control box 38' with its associated connections. Except for the evaporator plate 16', these components are substantially identical to the above-described prior art components and their operation is the same. A portion of the evaporator plate 16' is substantially identical in structure to that of the prior art and the function of such plate portion, i.e. for vaporization of refrigerant, is the same as that of the prior art. However, additional structure has been incorporated by the plate 16' in accordance with the improvements provided by the present invention to the prior art system. Such improved structure of the plate 16' will be described later on.

For conserving water usage and eliminating costly expense for additional water storage tanks, the present invention takes advantage of the excess cooling capacity of the prior art refrigeration system by providing means for cooling the hot water generated by the condenser unit 12' and stored within the storage tank 24', thereby rendering the same useable for cooling the condensation coils of the condenser unit 12'. More particularly, the hot water within storage tank 24' is also circulated through the evaporator plate 16' to cool the water and then it is returned for re-use in the condenser unit 12'. Specifically, a water discharge pipe or conduit 44 is connected to water storage tank 24' at approximately a position on the tank 24' where the water within the tank is 90° F. (due to the temperature gradient). The discharge conduit 44 extends to the inlet end of the evaporator plate 16' and runs therethrough, along and adjacent the refrigerant coils within the evaporator plate 16'. At the discharge end of the evaporator plate 16', a return water conduit 46 connects with the conduit 44 for returning the water to the cold water pipe 28'. A temperature responsive circulating pump 48 and one-way check valve 50 are interposed within conduit 46. The pump 48 is connected to a thermostat 52 located on the side of tank 24'. The thermostat 52 actuates operation of the pump 48 to circulate the hot water in the upper portion of the tank 24' through the above described circuit (i.e. conduit 44, evaporator plate 16' and conduit 46) when the thermostat 52 senses that the water in the tank 24' adjacent thereto has reached approximately 90° F.

In operation of the system 10', the refrigerant passes through the evaporator plate 16' absorbing the heat of the milk within reservoir 14' to thereby cool the same. The gaseous refrigerant then flows back to the condenser unit 12' wherein it changes back to a liquid state as cold water is circulated over the condenser coils. The hot water generated by the condenser coils then flows through hot water pipe 30' and is returned to the top of water storage tank 24'. A temperature gradient develops in the tank and hot water progressively moves lower and lower within the tank upon continued operation of the system. As 90° water reaches the region of the tank 24' where the thermostat 52 is located, the circulation pump 48 is actuated by the thermostat 52 which causes the 90° F. water to be drawn out of the tank 24' through discharge conduit 44 and moved through the evaporator plate 16' wherein the heat of the water is also absorbed by the refrigerant flowing through the plate 16'. The cooled water then returns through return conduit 46 and finally through pump 48 and valve 50 to cold water pipe 28' for re-use in the system.

The operation of the above-described improved refrigeration system is readily apparent from an examination of FIG. 2. It can be appreciated that the improved system accomplishes cooling of the excess hot water generated by the condenser unit 12' and its re-use in the milk cooling operation itself and, as a result, additional water storage tanks are not necessary to prevent water waste. Still further, it is clearly evident that the present invention takes advantage of and utilizes the extra cooling capacity of the commercially available refrigeration system to thereby provide a more efficient refrigeration system.

IMPROVED EVAPORATOR PLATE

As briefly mentioned above, the evaporator plate 16' incorporates additional structure over that of the prior art system which facilitates the cooling of hot water and in such manner makes more efficient utilization of the capacity of the prior art refrigeration system.

FIG. 3 shows an enlarged fragmentary sectional view of the preferred embodiment of the improved evaporator plate 16' utilized in the above-described improved refrigeration system. As was shown in FIG. 2, the evaporator plate 16' is disposed in the lower portion or bottom of reservoir 14'. The prior art structure of the plate 16' is comprised by plate 54, preferably formed of stainless steel material, and evaporator coils 56. The endless coils 56, which carry the refrigerant, are integrally formed by a corrugated sheet which is attached on the under surface of the plate 54 as seen in FIG. 3. The specific configuration of the coils 56 shown in FIG. 3, is exemplary of the prior art, it being understood that they could be shaped in any other conventional manner. The additional structure incorporated by plate 16' which constitutes the improvement over the prior art plate is the water conduit 44 which is disposed adjacent and attached to the coils 56 such that the refrigerant absorbs the heat of the hot water within conduit 44 as well as the heat of the warm milk that is resting on plate 54. In accordance with the second law of thermodynamics, heat is transferred from the hot water in conduit 44 through contiguous portions of conduit 44 and coils 56 into the cold refrigerant, concurrently as heat is transferred from the warm milk in the reservoir through plate 54 into the cold refrigerant flowing between plate 54 and coils 56.

In FIG. 4, an alternative construction of an evaporator plate for carrying out the principles of the present invention is shown. The evaporator plate 16' is of a sandwich construction having upper plate 54" and lower plate 58" spaced therefrom, both plates being preferably made of stainless steel material. Interposed between the upper and lower plates 54" and 58" is a convolute shaped or corrugated wall 60", also preferably of stainless steel, which is fixed such as by spot welding to the upper plate 52" at 60" and to the lower plate 58" at 62". The upper plate 54" and convolute shaped wall 60" are generally the same as plate 54 and coils 56 of FIG. 3 embodiment of the improved plate.

Such alternative construction of the improved plate 16" forms refrigerant passageways 64" and water passageways 66" as shown in FIG. 4. Thus, such alternative construction provides for passage of two separate mediums, the refrigerant and the water in close proximity to one another in a heat exchange relationship. Further, such construction provides a compact structure as well as one that is easily manufactured.

It is thought that the invention and many of its attendant advantages will be understood from the foregoing description and it will be apparent that various changes may be made in the form, construction and arrangement thereof without departing from the spirit and scope of the invention or sacrificing all of its material advantages, the form hereinbefore described being merely a preferred or exemplary embodiment thereof.

Having thus described the invention, what is claimed is:

1. An improved refrigeration system for cooling milk in a dairy operation comprising:

(a) a bulk-milk cooler tank for storage of the milk;

(b) an evaporator unit disposed within said milk storage tank and in contact with said milk stored therein;

(c) a water-cooled condenser unit including a refrigerant compressor and condenser coils operably interconnected with said evaporator unit for cooling the milk within said storage tank;

(d) means for supplying water to said condenser unit and circulating said water over and around said condensation coils during operation of said refrigeration system to cool and thereby condense the refrigerant carried by said coils; and (e) means for cooling the hot water generated by said water-cooled condenser unit during operation of said refrigeration system, said cooling means being interconnected between said water supply means and said evaporator unit, said cooling means includes water conduit coils in heat transfer relationship with said evaporator unit such that during operation of said refrigeration system, the refrigerant within said evaporator unit absorbs the heat of said hot water within said water coils as well as the heat of warm milk stored within said bulk tank, thereby cooling said water for reuse in said refrigeration system.

2. An improved refrigeration system for cooling milk in a dairy operation comprising:

(a) a bulk-milk cooler tank for storage of the milk;

(b) an evaporator unit disposed within said milk storage tank and in contact with said milk stored therein, the upper surface of said evaporator unit forms the bottom wall of said bulk milk tank, said evaporator unit including evaporator coils fixed to the underside of said upper surface;

(c) a water-cooled condenser unit including a refrigerant compressor and condenser coils operably interconnected with said evaporator unit for cooling the milk within said storage tank;

(d) means for supplying water to said condenser unit and circulating said water over and around said condensation coils during operation of said refrigeration system to cool and thereby condense the refrigerant carried by said coils; and (e) means for cooling the hot water generated by said water-cooled condenser unit during operation of said refrigeration system, said cooling means being interconnected between said water supply means and said evaporator unit and includes water coolant coils disposed in a heat transfer relationship with said evaporator coils.

3. An improved refrigeration system for cooling milk in a dairy operation comprising:

(a) a bulk-milk cooler tank for storage of the milk;

(b) an evaporator unit disposed within said milk storage tank and in contact with said milk stored therein;

(c) a water-cooled condenser unit including a refrigerant compressor and condenser coils operably interconnected with said evaporator unit for cooling the milk within said storage tank;

(d) means for supplying water to said condenser unit and circulating said water over and around said condensation coils during operation of said refrigeration system to cool and thereby condense the refrigerant carried by said coils, said water supply means includes a water supply tank interconnected with said condenser unit for supplying cold water to said condenser unit and for storing hot water generated by said unit during the condensation process, the hot water being returned to the upper portion of the tank whereas the cold water is removed from a lower portion of said tank thereby creating a water temperature gradient within said tank such that the temperature of the water progressively increases lower and lower within the tank during continued operation of the refrigeration system; and (e) means for cooling the hot water generated by said water-cooled condenser unit during operation of said refrigeration system, said cooling means being interconnected between said water supply means and said evaporator unit, said water cooling means including a water flow circuit connected at one end to an upper portion of said tank and at its other end to the lower portion of said tank and extending in a loop through said evaporator unit, and a temperature responsive water circulating pump interposed within said water circuit and operably associated with said storage tank to sense a predetermined temperature value of water within said tank such that said pump is actuated to draw hot water from said upper portion of said tank and circulate the same through said circuit whereby the temperature of said water is reduced due to heat transfer relationship with said evaporator unit.

4. The improved refrigeration system as described in claim 3, wherein:

said evaporator unit includes a plate forming the bottom wall of said bulk milk tank and evaporator coils attached to the underside of said plate for cooling said milk;

said water cooling means including water conduit coils disposed adjacent said evaporator coils and in heat transfer relationship therewith for cooling said hot water generated by said condenser unit to thereby cool the same for re-use of said water for cooling of said condenser unit.

5. The improved refrigeration system as described in claim 4, wherein:

said evaporator coils are integrally formed on the underside of said plate by a corrugated sheet attached to said plate so as to define hollow passageways for the flow of refrigerant therethrough; and said water conduit coils are located below, extend along, and are connected to said evaporator refrigerant coils.

6. An improved refrigerant system for cooling milk in a diary operation, comprising:

(a) a bulk-milk cooler tank for storage of the milk;

(b) an evaporator unit disposed within said milk storage tank and in contact with said milk stored therein;

(c) a water-cooled condenser unit;

(d) a refrigerant;

(e) means interconnecting said condenser unit and said evaporator unit for circulating said refrigerant between said condenser unit and said evaporator unit;

(f) means for supplying cold water to said condenser unit;

(g) said condenser unit being operable for causing circulation of said refrigerant through said circulating means between said condenser unit and said evaporator unit for cooling said stored milk by carrying off quantities of heat from said milk in said refrigerant from said evaporator unit to said condenser unit, said condenser unit further being operable for promoting the passing of said quantities of heat from said refrigerant and into said water being supplied to said condenser unit by said supplying means; and (h) means for circulating said water containing said quantities of heat from said condenser unit through said evaporator unit and back to said supplying means for re-supply thereof to said condenser unit after said quantities of heat have been removed thereof by said refrigerant at said evaporator unit.

7. In a refrigeration system having an evaporator unit disposed in heat exchange relationship with a liquid to be cooled and a water-cooled condenser unit interconnected to said evaporator unit and operable to circulate refrigerant to and from the same, an improved method for providing cool water to said condenser unit, comprising the steps of:

(a) supplying a predetermined quantity of cold water to said condenser unit;

(b) removing hot water from said condenser unit;

(c) circulating said hot water through said evaporator unit to cool said water; and (d) re-supplying said cooled water from said evaporator unit to said condenser unit for re-use by the same.

8. The improved method as set forth in claim 7, wherein said circulating step includes:

storing said hot water in a storage tank that is interconnected to said condenser unit; and routing said hot water from said storage tank through said evaporator unit to cool the same before re-use thereof in said condenser unit.

* * * * *

UNITED STATES PATENT OFFICE

CERTIFICATE OF CORRECTION

PATENT NO. : 4,130,996

DATED : December 26, 1978

INVENTOR(S) : Gratz M. Sult

It is certified that error appears in the above-identified patent and that said Letters Patent are hereby corrected as shown below:

In Column 1, line 16, after "condenser unit", insert --where the heat of the refrigerant, being circulated through the condenser unit--.

Signed and Sealed this

*Twenty-second* Day of *May 1979*

[SEAL]

*Attest:*

RUTH C. MASON
*Attesting Officer*

DONALD W. BANNER
*Commissioner of Patents and Trademarks*